US005191743A

United States Patent [19]

Gailey

[11] Patent Number: 5,191,743

[45] Date of Patent: Mar. 9, 1993

[54] CONCEALING TRIM CAP ASSEMBLY FOR A WALL OR CEILING PANEL SYSTEM

[75] Inventor: J. Lynn Gailey, Clover, S.C.

[73] Assignee: Alcan Aluminum Corporation, Cleveland, Ohio

[21] Appl. No.: 655,312

[22] Filed: Feb. 12, 1991

[51] Int. Cl.[5] ..... E04B 9/00

[52] U.S. Cl. ..... 52/718.05; 52/489; 52/288; 52/718.02

[58] Field of Search ..... 52/106, 288, 717.1, 52/718.1, 475, 489, 484

[56] References Cited

U.S. PATENT DOCUMENTS

| | | | |
|---|---|---|---|
| 866,479 | 9/1907 | Kiessel, Jr. | 52/717.1 X |
| 3,415,028 | 12/1968 | Nerem | 52/717.1 X |
| 3,475,870 | 11/1969 | Birum, Jr. | 52/288 X |
| 4,037,900 | 7/1977 | Schmidger | 52/717.1 X |
| 4,055,930 | 11/1977 | Weinar et al. | 52/717.1 |
| 4,754,586 | 7/1988 | Fujikawa | 52/717.1 X |
| 4,991,370 | 2/1991 | Gailey et al. | 52/484 |

*Primary Examiner*—David A. Scherbel
*Assistant Examiner*—Robert Canfield
*Attorney, Agent, or Firm*—Cooper & Dunham

[57] ABSTRACT

The invention provides a concealing trim assembly for a wall or ceiling panel system, comprising a trim member fastenable to a channel member of a ceiling or wall panel support, the trim member having a base portion and first and second means for slidably retaining a trim cap; means for fastening the trim member to the channel member; and a trim cap for concealing the means for fastening the trim member to the channel member. The trim cap has first and second edges matable with the first and second means for slidably retaining a trim cap, and at least one clip means for biasing the first and second edges of the trim cap with respect to the first and second means for retaining a concealment trim cap.

13 Claims, 3 Drawing Sheets

CONCEALING TRIM CAP ASSEMBLY FOR A WALL OR CEILING PANEL SYSTEM

BACKGROUND OF THE INVENTION

1. Field of the Invention

The present invention is directed to a concealing trim cap assembly for a wall or ceiling panel system, and more particularly to a trim cap assembly for a security ceiling for prison cells and the like.

2. Description of the Prior Art

United States patent application Ser. No. 295,824, filed on Jan. 11, 1989, (Gailey), now U.S. Pat. No. 4,997,570 entitled "Security Panel System" discloses a security panel system having a minimum number of structural components that can be readily constructed into security panels, such as the walls and ceilings of a prison cell or other detention facility. The security panel system disclosed therein, however, appears to have exposed screw or bolt heads where the trim member is fastened to the channel member, and the trim member appears to include no provision for concealing the screw or bolt heads. Even where tamper resistant screws or bolts are used in assembling the security panels into a wall or ceiling, the exposed bolt or screw heads provide an unnecessary opportunity for an inmate or detainee to try to disassemble the ceiling or wall in an attempt to escape.

It is therefore a principal object of the present invention to provide a secure trim assembly for wall or ceiling panel which covers exposed screw or bolt heads and other vulnerable points in the wall or ceiling security panel system.

SUMMARY OF THE INVENTION

The foregoing and other objects have been attained and the disadvantages of prior devices overcome by providing a concealing trim assembly for a wall or ceiling panel system, comprising a trim member fastenable to a channel member of a ceiling or wall panel support, the trim member having a base portion and first and second means for slidably retaining a trim cap; means for fastening the trim member to the channel member; and a trim cap for concealing the means for fastening the trim member to the channel member. The trim cap has first and second edges matable with the first and second means for slidably retaining a trim cap, and at least one clip means for biasing the first and second edges of the trim cap with respect to the first and second means for retaining a concealment trim cap.

Preferably, the first means on the trim member includes a first channel extending longitudinally on a first side of the trim member, while the second means on the trim member includes a second channel extending longitudinally along a second and opposite side of the trim member. In the preferred embodiment disclosed herein, the first channel is offset with respect to the second channel, and the trim member has a base portion having a generally L-shaped cross-section.

Advantageously, the first channel extends along the first edge of the trim member, and is generally C-shaped in cross-section. The second channel is formed by a recess included in the second edge of the trim member which cooperates with a longitudinal edge of the channel member to form the second channel when the trim member is fastened to the channel member. The first channel may also be a recess formed between first and second arms extending longitudinally along and substantially parallel to the base portion of the trim member.

The invention also provides a concealing trim assembly for a wall or ceiling panel system, comprising a trim member including a generally L-shaped base portion having a first leg substantially perpendicular to a second leg. The trim member also has a first channel defined by a recess formed between first and second fingers extending parallel to the base portion, and a second channel formed by a depression in an opposite side of the base, which is preferably offset with respect to the first channel. The assembly also includes a trim cap having first and second edges, the first edge offset with respect to the second edge, for slidable retention in the first and second channels of the trim member. The assembly further includes a clip means for locking the first and second edges of the trim cap against the first finger and the side forming the depression in the trim member, and means for fastening the clip means and the trim member to the channel member.

As a further feature of the invention, the means for fastening the clip and the trim member is a single screw which fastens the clip and the trim member to the channel member. The invention also features a clip having a bottom portion including an aperture for a screw and a tongue extending at an angle from the bottom portion.

The invention further provides a concealing trim assembly wherein the clip has a flange having an aperture to receive means for fastening the clip to the trim member and a generally U-shaped tongue which extends at an acute angle from adjacent the trim member to adjacent the first channel.

Other features, aspects and advantages of the invention may be understood by reviewing the following detailed description of the preferred embodiments.

DETAILED DESCRIPTION OF THE PREFERRED EMBODIMENT

Figure 1:
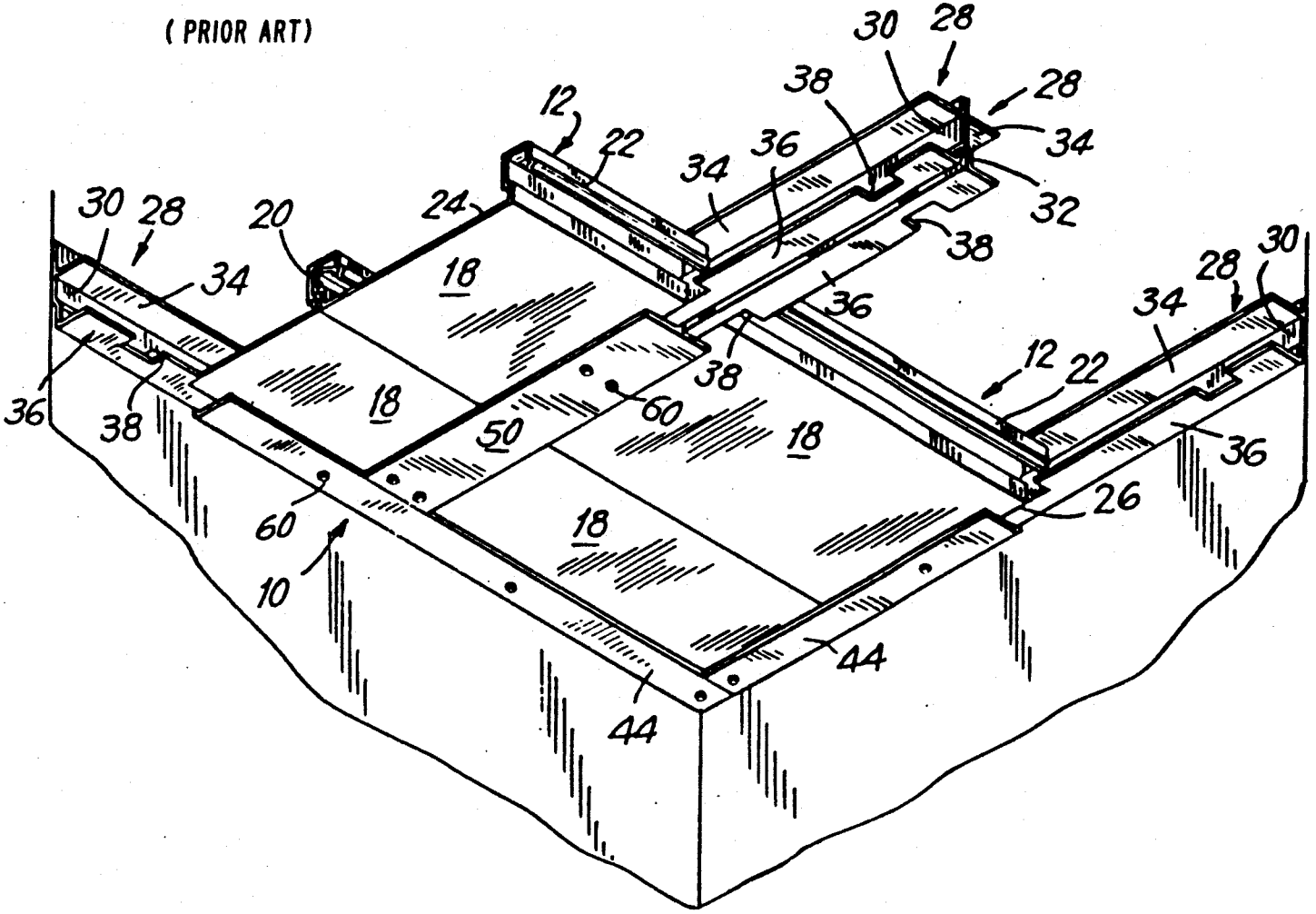
FIG. 1 (PRIOR ART)
FIG. 1 is a bottom perspective view of a prior ceiling structure for which the trim assembly of the present invention is particularly adapted

Referring to FIG. 1, there is shown a security wall or ceiling panel system as disclosed in U.S. patent application Ser. No. 295,827, filed on Jan. 11, 1989, (Gailey), the entire disclosure of which is incorporated herein by reference and made a part hereof. The security panel system 10 is illustrated as a ceiling being constructed above the walls 11 of a room structure such a detention cell. The security panel system 10 includes generally flat pan members 18 having ribs 20 and 22 which can interlock by snapping two adjacent pan members 18 together so that rib 20 slidably inserts into rib 22. The security panel system 10 includes channel members 28 which may be combined to form carrier members which allow joinder of adjacent rows of pan members 18. The security panel system lo also includes trim members 44 which capture the ends of pan members 18. Such a trim member 44 is shown in FIG. 1 as having an L-shaped cross-section to cover the edge of pan member 18, that is, prevent access to its ends and limit its capability to be disassembled.

Figure 2:
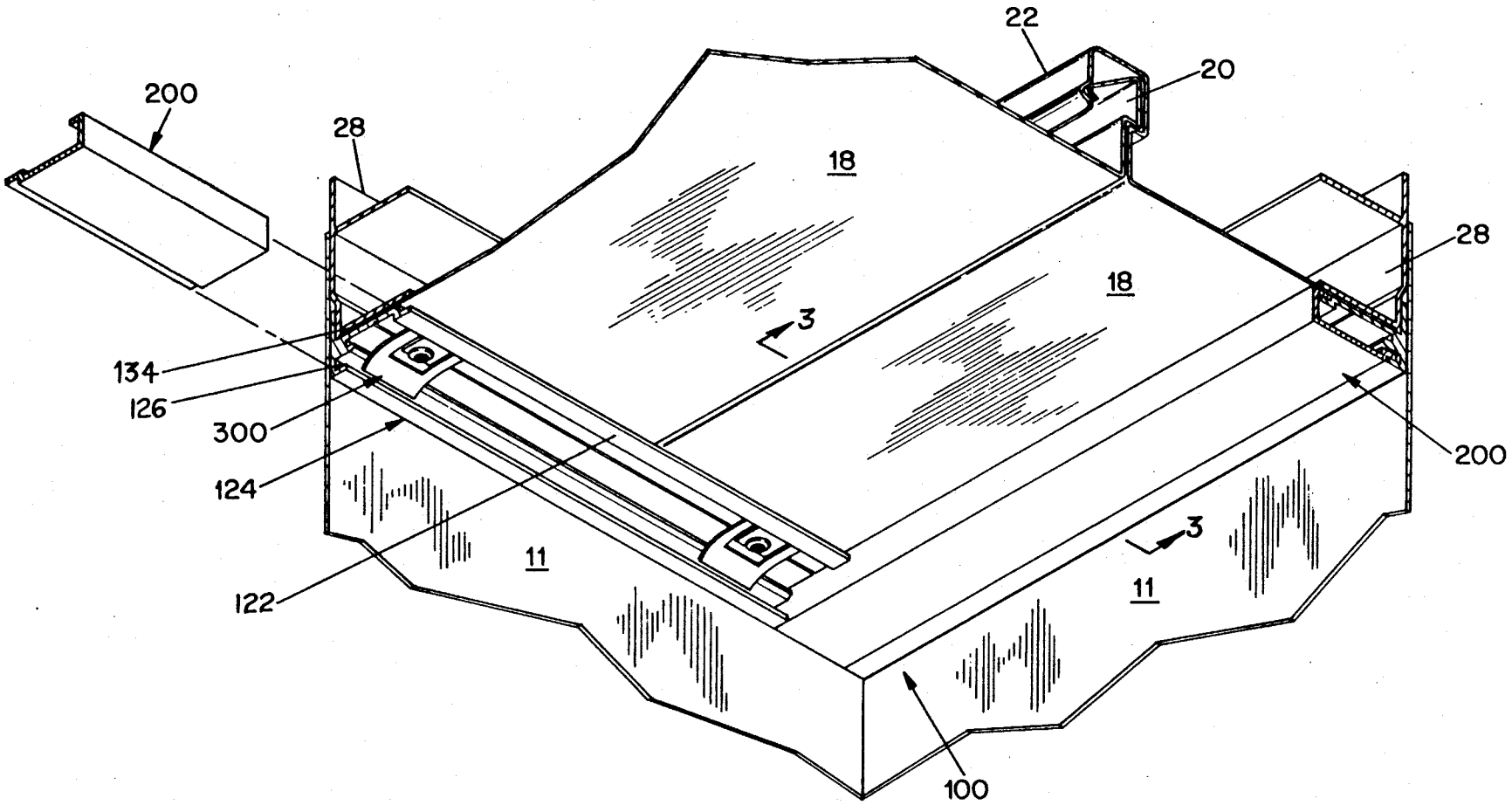
FIG. 2 is a bottom perspective view of a preferred embodiment of the trim assembly of the present invention shown mounted on the ceiling structure of FIG. 1.

The trim assembly of the present invention provides an improvement over trim member 44 shown in FIG. 1. As shown in FIG. 2, the improved trim assembly, generally designated by the reference numeral 100, includes three principal parts: a trim member 110, a trim cap 200 and at least one clip means 300.

Figure 3:
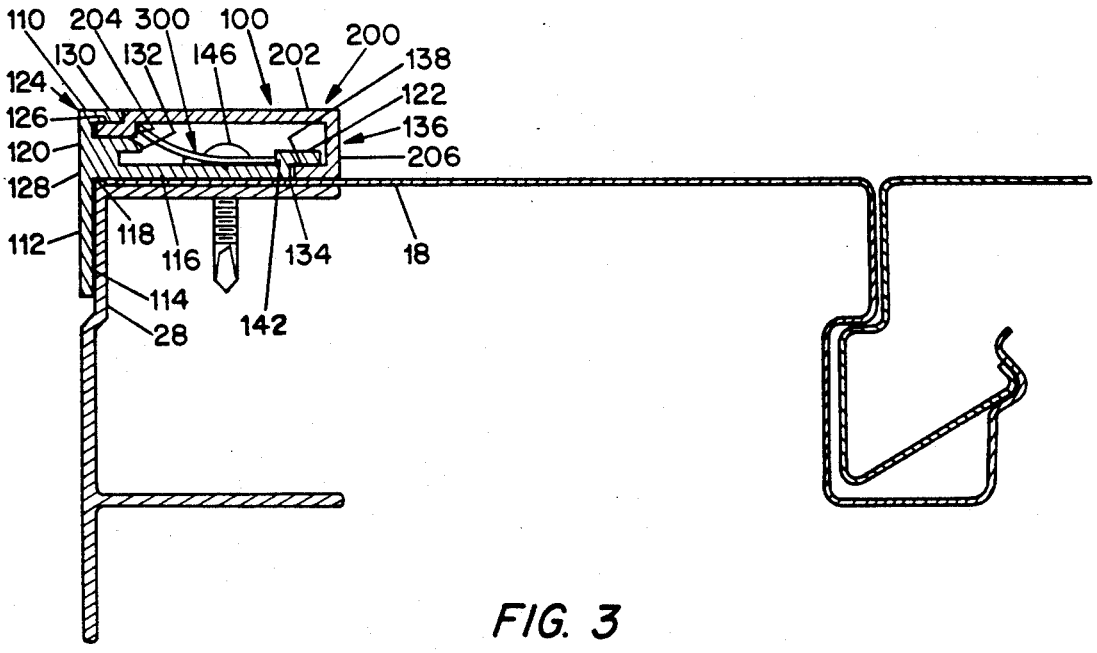
FIG. 3 a cross-sectional view of the trim assembly taken along line 3—3 of FIG. 2.
Figure 3A:
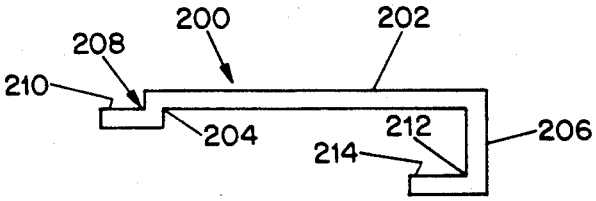
FIG. 3A a cross-sectional view of the trim cap for use in the trim assembly of FIG. 2.

As shown in FIGS. 2 and 3, the trim member 110 has a base portion 112 having a generally L-shaped cross section formed by first and second arms 114, 116 which meet to form an approximately right angle 118. The arms 114, 116 are sized to overlap a corner of channel member 28 and the edge of pan member 18 to cover the exposed edges of pan member 18 and channel member 28 with a rigid structure which resists bending and tampering as required in security and prison applications.

Trim member 110 also includes first 120 and second 122 means for slidably retaining a trim cap 200. Preferably, first means 120 is positioned on a first side 124 of the trim member 110 and includes a first channel 126 (see FIG. 3) extending longitudinally along the first side 124 of the trim member 110. As shown most clearly in FIG. 2, the first means 120 is generally C-shaped in cross-section, and includes spine 128 extending upward from arm 116 and first 130 and second 132 fingers substantially parallelly spaced to form first channel 126, which is, in effect, a recess or space between the first 130 and second 132 fingers. As shown in FIG. 3, the first and second fingers 130, 132 extend longitudinally along, and are substantially parallel to, arm 116 of the trim member 110.

As mentioned above, trim member 110 also includes second means 122 for slidably retaining a trim cap 200, as shown in FIG. 3. The second means 122 includes a second channel 134 extending longitudinally along a second side 136 of the trim member 110. The second channel 134 may have a generally C-shaped cross-section similar to the first channel 126, but preferably the second channel 134 is formed as a recess defined by third finger 138 on trim member 110 which cooperates with the adjacent longitudinal edge of pan member 18 or channel member 28 where the trim member 110 overlaps and is fastened to the channel member 28. As shown in FIGS. 2 and 3, second means 122 is formed by second spine 142 extending upward from second arm 116 and third finger 138 extending outward at a substantially right angle from second spine 142. As also shown in FIGS. 2 and 3, the first channel 126 faces the same direction as the second channel 134, but they are preferably offset with respect to one another. That is, the first channel 126, as shown in FIG. 3, is positioned higher with respect to pan member 18 than the second channel 134, so that the trim assembly 100 provides no exposed edges facilitating unauthorized prying or removal, and so that the clip 300 can bias the trim cap 200 against the trim member 110, as will be described below.

The trim member 110 also includes means for fastening the trim member to the channel member 28 such as an aperture (not shown) for receiving a screw 146, bolt, pop rivet or other mechanical fastening means known to those of ordinary skill in the art. Preferably, the screw 146 used in fastening the trim members 110 to the channel members 28 should not respond to commonly available flat blade or Philips head screwdrivers. In this way, should tampering occur, the screw 146 would resist unauthorized loosening or removal.

Figure 4:
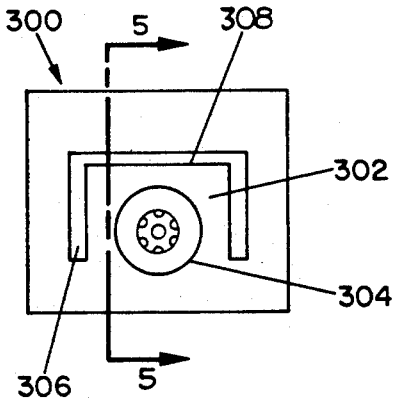
FIG. 4 is a perspective view of a clip for use in the trim assembly invention shown in FIG. 2.

The first 126 and second 134 channels of the trim member 110 slidably engage the trim cap 200, as shown in FIGS. 2 and 4. The trim cap 200 conceals means for fastening the trim member 110 to the channel member 28, and is adapted to mate with first and second channels 126, 134 on trim member 110. Accordingly, the trim cap 200 should preferably have a top 202, a central longitudinally extending portion and bounded by first 204 and second 206 elbows. The first elbow 204, which engages the first channel 126 on the trim member 110, extends downwardly and outwardly from top 202 at a substantially right angle 208 and forms first edge 210 which may slide into first channel 126 to be slidably retained therein.

Similarly, a second elbow 206 downwardly but inwardly extends from the other side of trim cap 200, also at a substantially right angle 212 to form second edge 214 which may slide into and engage second channel 134. Both the trim member 110 and trim cap 200 can be fabricated from steel stainless steel, aluminum or an aluminum alloy using a conventional continuous casting method or other conventional method of construction.

Figure 5:
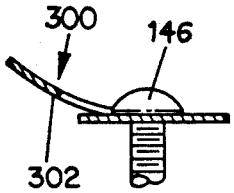
FIG. 5 is a cross-sectional view of the clip of FIG. 4 taken along line 5—5 of FIG. 4.

In addition, the trim assembly 100 preferably includes at least one clip 300 or spring means for biasing the first 210 and second 214 edges of the trim cap 200 against the underside of first 132 and third 138 fingers of trim member 110 to retain the trim cap 200 in place and avoid tampering or unauthorized removal. The clip 300, preferably made of spring steel, has a flange 302 having a centrally disposed aperture 304 through which screw 146 or other fastening means may affix the clip 300 on the trim member 110. The clip 300 has a U-shaped slot 306 dividing flange 302 from tongue 308. Tongue 308 curves upward at a preferably acute angle, as shown in FIG. 5, to provide a biasing force to lock the trim cap 200 against trim member 110.

The trim assembly 100 components may be put together as shown in FIGS. 2 and 3. After pan members 18 are snapped together, and the outermost pan member 18 is inserted into channel member 28 to form a ceiling structure as illustrated in FIG. 1, the trim components of the present invention may be installed. First, trim member 110 is positioned so that arms 114, 116 abut the exposed edges of channel member 28 and adjacent pan member 18. Once in place, trim member 110 should cover such exposed edges. While holding trim member 110 in position, clip 300 is aligned so that its aperture 304 is concentric with the aperture (not shown) on trim member 110, and then screw 146 is inserted through aperture 304 and the aperture in the trim member 110 and driven into place. Each additional aperture (not shown) on trim member 110 is similarly provided with a clip 300 and screw 146. Next, trim cap 200 is slid into place over clip 300 by engaging first and second longitudinally extending channels 126, 134 and sliding the trim cap 200 into place. The trim assembly 100 is now in place, thereby covering over the channel members 28 and the screws 146 or other fastener, to prevent tampering or unauthorized removal. The installed trim assembly 100 has an attractive appearance with clean lines.

It should be understood that a preferred embodiment of a trim assembly has been described, and that many alterations, modifications, and changes in the invention may occur to persons of ordinary skill. For example, the trim assembly may be used in other paneling and ceiling environments. Indeed the trim assembly 100 is so functional and attractive that it may be used without substantial modification in homes and offices. In addition, adjustments may be made to the overall geometry of the trim assembly 100, such as changing the degree of offset of the first and second channels 126,134. It is therefore intended that the scope of the invention be governed solely by the following claims, including all equivalents.

I claim:

1. A concealing trim assembly for a wall or ceiling panel system, comprising:

a trim member fastenable to a channel member of a ceiling or wall panel support, the trim member having a base portion and first and second means for slidably retaining a trim cap;

means for fastening the trim member to the channel member;

a trim cap for concealing said means for fastening the trim member to the channel member, said trim cap having first and second edges matable with said first and second means for slidably retaining a trim cap;

at least one clip means for biasing said first and second edges of said trim cap against said first and second means for retaining a trim cap.

2. A concealing trim assembly in accordance with claim 1, wherein said first means on said trim member includes a first channel extending longitudinally on a first side of said trim member.

3. A concealing trim assembly in accordance with claim 2, wherein said second means on said trim member includes a second channel extending longitudinally along a second and opposite side of said trim member.

4. A concealing trim cap assembly in accordance with claim 3, wherein said first channel is offset with respect to said second channel.

5. A concealing trim cap assembly in accordance with claim 4, wherein said trim member includes a base portion having a generally L-shaped cross-section.

6. A concealing trim assembly in accordance with claim 4, wherein said second channel is formed by a recess included in said second side of said trim member which cooperates with a longitudinal edge of said channel member or pan member to form said second channel when said trim member is fastened to said channel member or pan member.

7. A concealing trim assembly in accordance with claim 6, wherein said first channel extends along said first side of said trim member, and is generally C-shaped in cross-section.

8. A concealing trim assembly in accordance with claim 7, wherein said first channel is a recess formed between first and second fingers extending along and substantially parallel to said trim member.

9. A concealing trim assembly for a wall or ceiling panel assembly, comprising:

a trim member including a generally L-shaped base portion having a first leg substantially perpendicular to a second leg, a first channel defined by a recess formed between first and second fingers extending parallel to said base portion, and a second channel formed by a depression in an opposite side of said base, said second channel offset with respect to said first channel;

a trim cap having first and second edges, said first edge offset with respect to said second edge, for slidable retention in said first and second channels of said trim member;

clip means for biasing said first and second edges of said trim cap against said first finger and said depression in said trim member; and means for fastening said clip means and said trim member to said channel member.

10. A concealing trim assembly in accordance with claim 9, wherein said means for fastening said clip and said trim member is a screw which fastens said clip means and said trim member to said channel member.

11. A concealing trim assembly in accordance with claim 10, wherein said clip means has a bottom portion including an aperture for a screw and a tongue extending at an angle from said bottom portion.

12. A concealing trim assembly in accordance with claim 11, wherein said tongue is fastened to said trim member between said first and second edges and extends at an acute angle from adjacent said trim member to adjacent said first channel.

13. A concealing trim assembly for a wall or ceiling panel system, comprising:

a trim member including an L-shaped bracket for engaging first and second substantially perpendicular sides of a channel member of said ceiling or wall panel system, the trim member also having first and second inwardly directed fingers positioned at a first predetermined distance above a first side of said trim member to form a first longitudinal channel, and a third finger extending in the same direction as said first and second fingers and extending above said first side of said channel member a second predetermined distance which is less than said first predetermined distance, said third finger and an edge of said channel member or said pan member forming a second longitudinal channel offset from said first longitudinal channel;

a trim cap having a central longitudinally extending portion, a first elbow downwardly and outwardly extending from one side of said central longitudinally extending portion and a second elbow extending downwardly and inwardly from an opposite side of said central longitudinally extending portion of said trim cap, said first and second elbows sized to mate with said first and second channels when said trim cap slidably engages said trim member; and clip means including a tongue extending from said trim member at an acute angle toward said first channel for biasing said first edge of said trim cap against said first finger of said trim member and said second leg of said trim member against said third finger of said trim member, said clip member having an aperture for receiving means to fasten said clip member to said trim member or pan member.

* * * * *